US008941270B2

(12) United States Patent
Pelrine et al.

(10) Patent No.: US 8,941,270 B2
(45) Date of Patent: Jan. 27, 2015

(54) MANUFACTURING USING LEVITATED MANIPULATOR ROBOTS

(75) Inventors: Ronald E. Pelrine, Longmont, CO (US); Annjoe Wong-Foy, Pacifica, CA (US); Brian K. McCoy, Sunnyvale, CA (US)

(73) Assignee: SRI International, Menlo Park, CA (US)

( * ) Notice: Subject to any disclaimer, the term of this patent is extended or adjusted under 35 U.S.C. 154(b) by 70 days.

(21) Appl. No.: 13/560,754

(22) Filed: Jul. 27, 2012

(65) Prior Publication Data

US 2013/0027159 A1 Jan. 31, 2013

Related U.S. Application Data

(60) Provisional application No. 61/512,106, filed on Jul. 27, 2011.

(51) Int. Cl.
*H01F 7/00* (2006.01)
*H01F 7/02* (2006.01)

(52) U.S. Cl.
CPC ..... *H01F 7/00* (2013.01); *H01F 7/0236* (2013.01)
USPC ..... 310/12.05; 310/12.21; 422/68.1

(58) Field of Classification Search
CPC ..... H01L 2224/13111
USPC ..... 310/12.05, 12.21; 318/696; 422/68.1
See application file for complete search history.

(56) References Cited

U.S. PATENT DOCUMENTS

| | | | | |
|---|---|---|---|---|
| 3,263,841 | A * | 8/1966 | Wanesky | 414/403 |
| 3,391,671 | A * | 7/1968 | Windsor | 118/706 |
| 4,864,797 | A | 9/1989 | Sato et al. | |
| 5,099,216 | A | 3/1992 | Pelrine et al. | |
| 5,396,136 | A * | 3/1995 | Pelrine | 310/90.5 |
| 5,820,716 | A | 10/1998 | Tuttle | |
| 6,858,184 | B2 * | 2/2005 | Pelrine et al. | 422/68.1 |
| 2002/0106314 | A1 * | 8/2002 | Pelrine et al. | 422/186 |
| 2004/0183382 | A1 | 9/2004 | Delaware et al. | |
| 2008/0095667 | A1 * | 4/2008 | Murakami et al. | 422/68.1 |
| 2012/0139365 | A1 * | 6/2012 | Pelrine et al. | 310/12.05 |

* cited by examiner

*Primary Examiner* — Mohamad Musleh
(74) *Attorney, Agent, or Firm* — Marger Johnson & McCollom PC

(57) ABSTRACT

A method of building structures using diamagnetically levitated manipulators includes depositing, with a first end effector attached to a first manipulator, a first adhesive at a first location on a first surface, picking up, with a second end effector, an article, moving the article to the surface, and placing the article on the adhesive on the surface.

12 Claims, 17 Drawing Sheets

MANUFACTURING USING LEVITATED MANIPULATOR ROBOTS

RELATED APPLICATIONS

This application claims priority to U.S. Provisional Patent Application 61/512,106, filed Jul. 27, 2011, incorporated by reference herein in its entirety.

BACKGROUND

Magnet levitation has many possible applications. U.S. Pat. No. 5,099,216, "Magnetically Levitated Apparatus," to Pelrine, discusses magnetically levitated robotic manipulators. The manipulators have attached magnetically active components, such as permanent magnets, upon which magnetic forces are imposed by fields generated by electromagnets. The discussion also addresses stability and damping of the motion of the robotic manipulators, where the manipulators can move with six degrees of freedom.

U.S. Pat. No. 5,396,136, "Magnetic Field Levitation," to Pelrine, discusses the use of a magnetic member having an array of magnets and a diamagnetic or other material having magnetic permeability of less than one. The diamagnetic material acts as a base defining an area over which the magnetic member can levitate and be moved by external magnetic forces. In some embodiments, the diamagnetic material does not fully levitate the magnetic member but provides lift forces that reduce the effective load of the magnetic member on a moving surface.

These approaches generally rely upon an array of electromagnets to provide the magnetic fields to act upon the magnetic robots. The arrays of electromagnets determine the regions upon which the robots can be controlled by the fields generated by the electromagnets. While these arrays provide reasonably precise control of the robots, they still require electromagnets to provide the external forces that act on the robots. Another approach, discussed in U.S. Pat. No. 6,858,184, "Microlaboratory Devices and Methods," uses a substrate having within it biasing elements in conjunction with an array of drive elements above the substrate. The drive elements move the magnetic elements in the space between the drive elements and the substrate.

In a different approach, the fields to levitate the magnetic robots may originate from current passing through conductive traces layered in a circuit substrate. Such approaches are discussed in U.S. patent application Ser. Nos. 12/960,424 and 13/270,151, incorporated by reference in their entirety here. These approaches allow for greater flexibility in the structure and uses of the manipulators, as well as their movement.

DETAILED DESCRIPTION OF THE EMBODIMENTS

U.S. patent application Ser. Nos. 12/960,424 and 13/270,151 mention that diamagnetically levitated manipulators, also referred to as micro-robots when they are sized on the micron to millimeter scale, may be used to move materials around on circuit substrates. This ability makes possible the automated micro-factory using diamagnetically levitated manipulators. One should note, however, that the size is not constrained to be so small. That is merely one domain in which these manipulators are uniquely useful. The manipulators may be useful if made smaller and larger. For that reason they will typically be referred to here as manipulators, rather than micro-robots. Similarly, the diamagnetic material acts as a base defining an area over which the magnetic member can levitate. In some embodiments, the diamagnetic material does not fully levitate the magnetic member but provides lift forces that reduce the effective load of the magnetic member on a moving surface. For purposes of discussion here, the manipulator is considered to be 'partially' levitated, so the use of the term 'levitated manipulator' includes those embodiments in which the manipulator remains in contact with the surface.

As disclosed in the '424 and '151 patent applications, the levitated manipulators move in response to magnetic fields caused by electrical current moving through conductive traces. Further development has produced manipulators having good open-loop repeatability. Conventional robots and other mobile machines usually have poor open-loop repeatability because of friction, surface adhesion, mechanical tolerances in their joints and hysteresis. Levitation eliminates friction and surface adhesion, and the manipulators here are single, rigid objects. Further, the use of diamagnetic materials, which have zero hysteresis, do not suffer from the hysteresis of ferromagnetic materials. Experiments have shown the measured-position repeatability of the diamagnetically levitated manipulators using macroscopic motion to be 200 nanometers rms, with control data without macroscopic motion showing 165 nm rms noise.

The precise movement capabilities of these manipulators make many manufacturing and other types of tasks possible in an automated, levitated manufacturing environment. The materials handled by the manipulators may include liquids or dry materials. The manipulators have tools, or end effectors, attached to the body of the manipulator. As will be seen in the embodiments, the body of the manipulator may consist of a unit attached to an array of magnets, or the body may consist of the array of magnets. The term 'array' as used here includes a single unit, an array of one. However, in instances where there is a body, the array of magnets may consist of several magnets distributed around the body.

Figure 1:
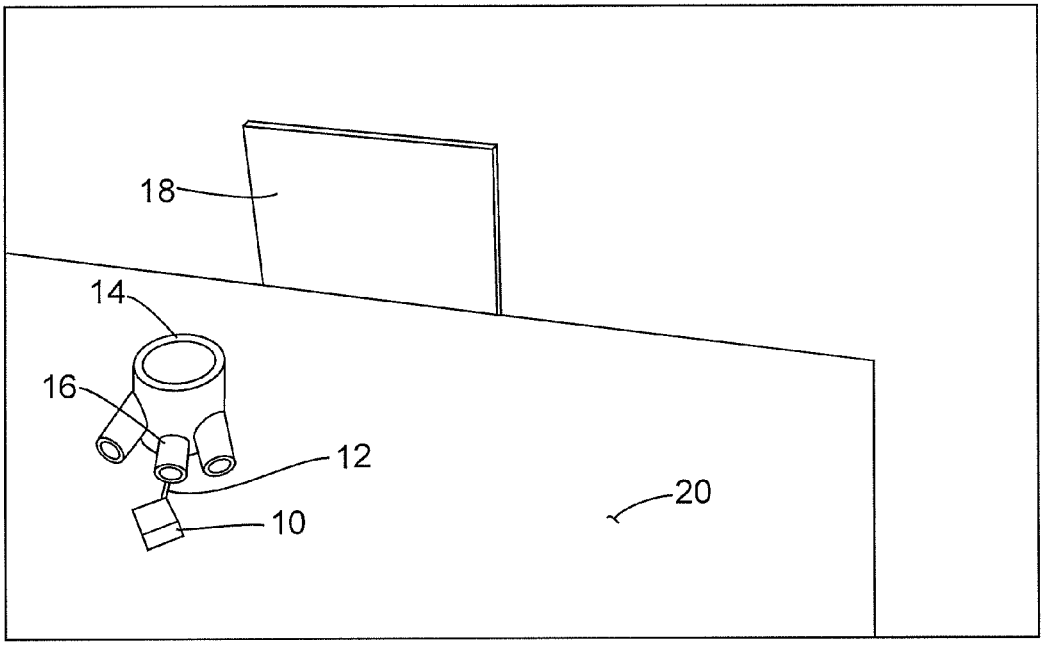
FIGS. 1-2 show an embodiment of a levitated manipulator depositing conductive liquid to form a conductive trace.

FIG. 1 shows an example of a manipulator having a liquid dip tip end effector. The dip tip can be a simple wetting tip that picks up a drop of liquid, or it can be a more complex structure such as a brush, loop, or coil to hold larger quantities or more controlled quantities of liquid. The manipulator 10 resides on a circuit substrate 20 that has a diamagnetic layer either on the surface or within it. The dip tip or other end effector 12 that can hold liquid in some manner is inserted into an access port 16 on a liquid reservoir 14. In this particular embodiment, the liquid inside the reservoir consists of some sort of conductive liquid or paste. In alternate embodiments, the liquid or paste may become conductive when it cures or dries. The manipulator picks up some quantity of the liquid and then transports it to a circuit substrate such as 18.

One should note that the circuit substrate in this instance is perpendicular to the substrate upon which the manipulator resides. However, it is possible that the substrate may be flat relative to the manipulators. The deposition process may involve tilting the manipulator to cause a drop on the tip to contact and 'stick' to the substrate. The tilting of manipulators is discussed in more detail further. As long as consideration is given to the movement path of the manipulator, one can employ many different movement techniques to deposit the liquid to a predetermined location. By repeatedly depositing the liquid, the manipulator can form a conductive circuit trace. This technique can be used for many other types of liquids and applications, the conductive liquid to build a conductive trace merely provides one example. The dispensing could include adhesives, protective coatings, inks, two-step processes in which two reactants are brought together, etc.

Figure 2:
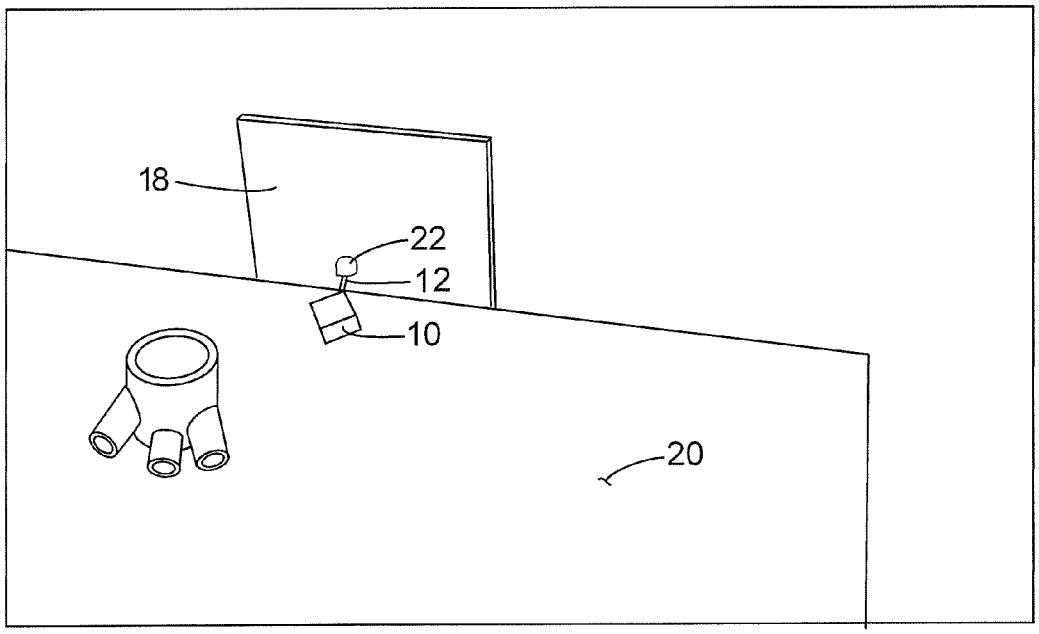

FIG. 2 shows the manipulator 10 positioned to deposit the conductive material onto the substrate 18. As mentioned above, by controlling the movement of the manipulator precisely, the drops can be deposited to form conductive traces on the substrate, such as 22.

The manipulators have no limitation as to the complexity of manufacturing processes. Insulating liquid-based materials can also be deposited in conjunction with conductive liquid-based materials to electrically isolate two deposited conductive traces with an insulating layer in between. Deposited liquids, once cured or dried, can also be repeatedly deposited to build up 3 dimensional structures.

Figure 3:
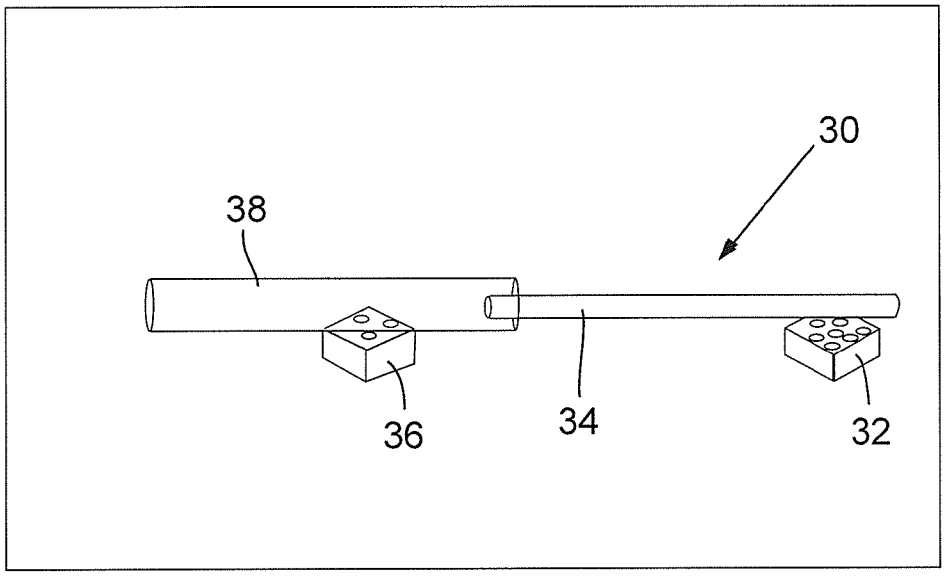
FIGS. 3-4 show an embodiment of a levitated manipulator having a plunger and reservoir.
Figure 4:
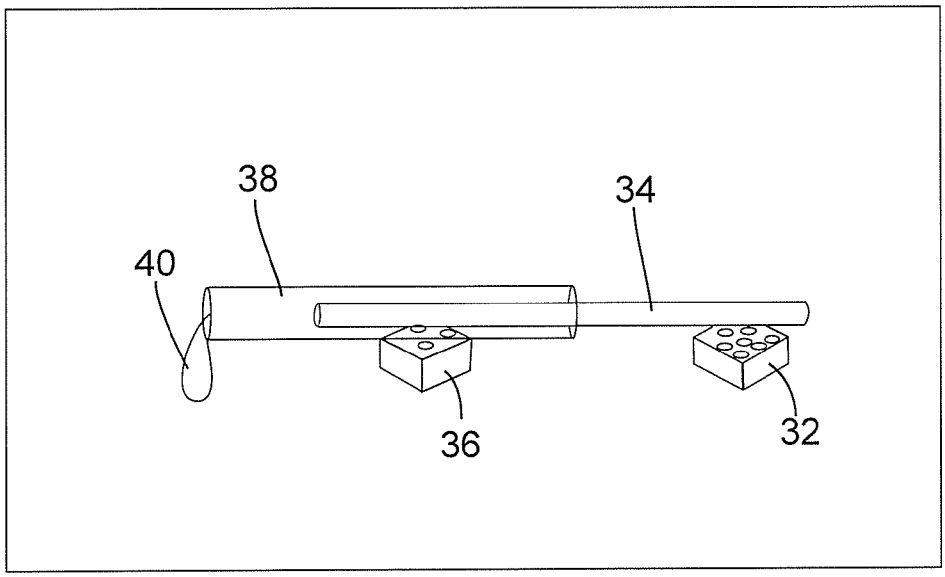

The embodiments of FIGS. 1-2 disclose a relatively simple liquid dispensing system. FIGS. 3 and 4 give an example of a more complex embodiment using multiple arrays of magnets and controlling them simultaneously and separately. FIG. 3 shows a syringe type dispenser 30. The syringe has a first array of magnets 32 attached to a plunger 34. A second array of magnets 36 is attached to a reservoir 38.

Initially, the two arrays of magnets will typically move simultaneously to locate the syringe structure in a predetermined location. The reservoir could contain a liquid for dispensing, or could receive a liquid being aspirated, depending upon the needs of the system. The reservoir could have a small pipe or needle attached to its end as well, either straight or slightly hooked to allow it to pick up liquids. Once the syringe is located in the desired location, the arrays of magnets are moved separately from each other to move the plunger either towards the liquid dispensing end 40 of the reservoir (dispensing) or away from it (aspirating). FIG. 4 shows the plunger 34 moving towards the liquid dispensing end of the reservoir 38, causing a drop of liquid 40 to exit the reservoir.

Figure 5:
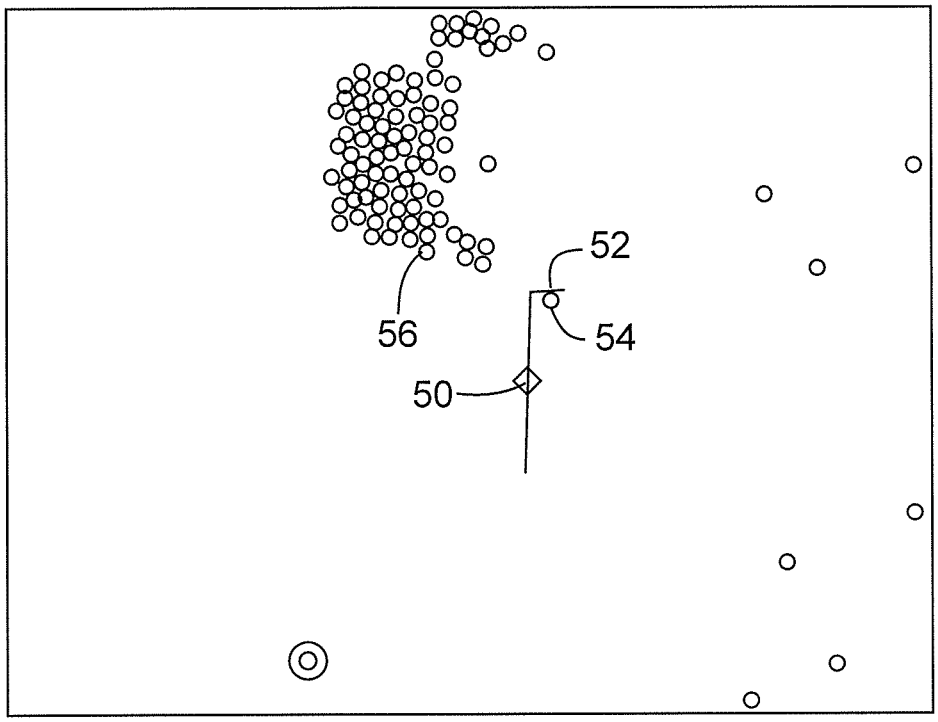
FIGS. 5-6 show embodiments of end effectors for handling dry materials.

The discussion has focused on simple and complex ways in which the manipulators can handle liquids. The manipulators can also handle dry materials. An advantage lies in the flexibility of the end effectors. For example, FIG. 5 shows an end effector used to cingulate one article from a group of articles. In this particular embodiment, the articles are beads randomly placed in a general predetermined location 56. The manipulator may consists of two arrays of magnets 50 fixed together by the body of the manipulator, or any other number of arrays of magnets, as well as the body itself being formed from magnets. The end effector in this embodiment consists of a hook 52. The manipulator moves into the group of articles, in this case beads, and extracts one or more articles, such as bead 54. The hook may take one of many forms, such as a hook dimensioned to allow only one article at a time to be extracted, singulating the beads. The system does not need to know the exact location of any particular bead that is extracted. Rather, the hook can be inserted by the manipulator into the general predetermined location 56 and a single bead can be extracted using a sweeping motion. Some embodiments of the system employ sensors such as optical sensors to verify that the manipulator has successfully extracted a single bead or part. Alternatively, the hook may allow for pairs, triples, etc. of the articles, depending upon the manufacturing needs.

Figure 6:
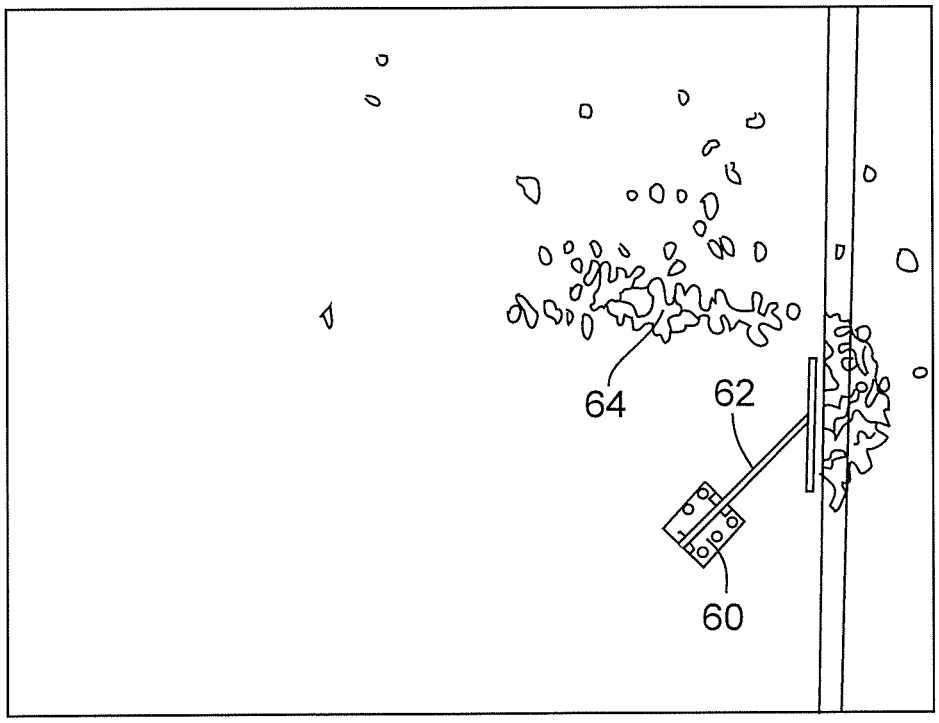

FIG. 6 shows another embodiment of a dry material manipulator. In this instance, the manipulator 60 has a pushing or broom end 62. The manipulator may be employed to clean a surface, or to pile materials into a known location. In this particular embodiment, the manipulator pushes powder debris 64 off to the side of the circuit substrate. The debris may result from another manufacturing process, contamination, etc. Similar to the liquid handling, the manipulators enable more complex material handling tasks.

Figure 7:
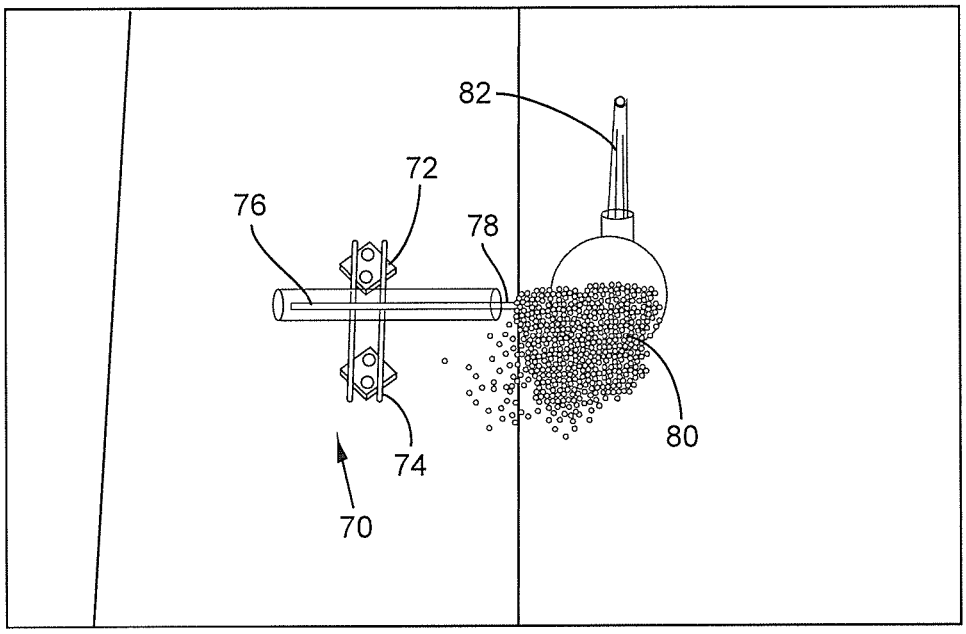
FIGS. 7-8 show an embodiment of a levitated manipulator to melt powder.
Figure 8:
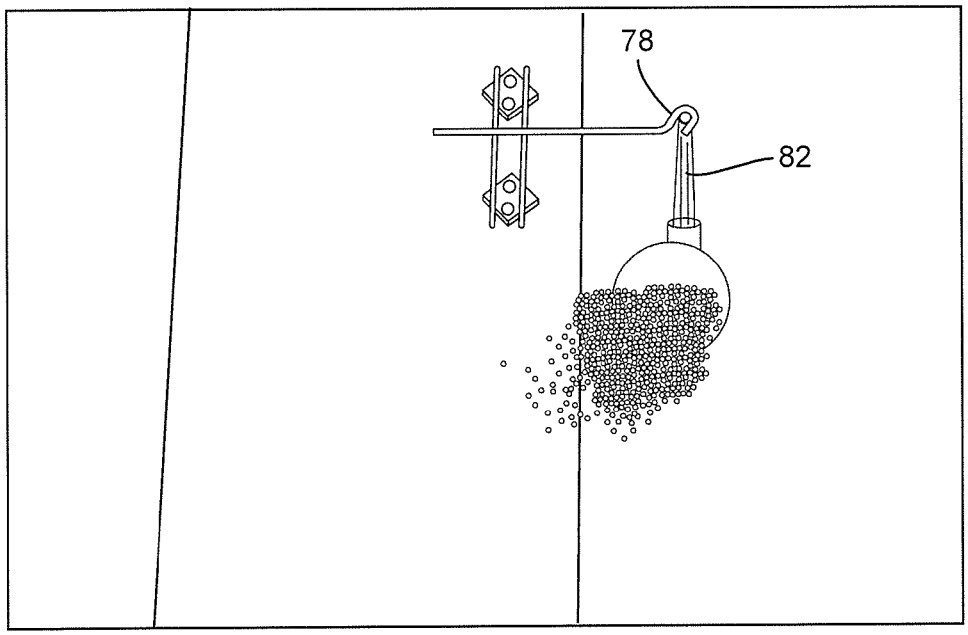

FIGS. 7-8 show an embodiment of collecting and then melting a powder as may be used in manufacturing processes. FIG. 7 shows a manipulator 70 used in a melting process. The manipulator here may consist of two arrays of magnets 72 and 74 having a thermal isolator between then. In this embodiment, the thermal insulator 76 consists of a glass tube that encases the tungsten or other metal wire making up the end effector 78 at its end. The wire attaches to the thermal isolator, in this case the glass tube, to manage the heat from the flame or heat source.

In operation, the end effector maneuvers into a reserve of powder 80. Some quantity of the powder is retained in the end effector 78, which in this case is configured as a scoop. The manipulator then moves to bring the scoop near the flame 82, as shown in FIG. 8. The flame in this embodiment is collocated with the reserve of powder, but could be located in any location to which the manipulator can move. Other sources of heat can be used instead of a flame 82, such as a heater or an electric heating element such as a resistive or inductive heater. The melted powder may then be used in different manufacturing processes. While the material here is a melted powder, it could consist of any type of material that can be melted.

Figure 9:
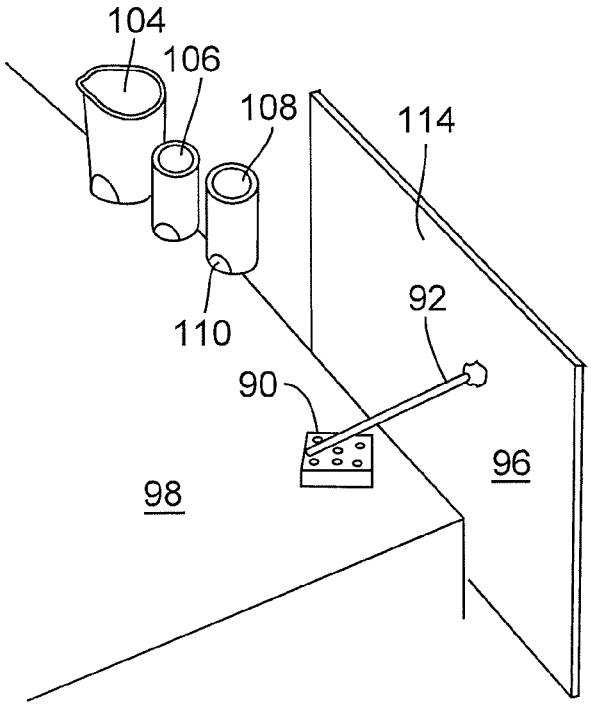
FIG. 9 shows an embodiment of an arc cutting levitated manipulator.

The manipulators can also use other types of manufacturing technologies. FIG. 9 shows an example of manufacturing a patterned circuit substrate by arc cutting. The manipulator 90 resides on a diamagnetic material 98 such as graphite. The diamagnetic material 98 may be coated with other conductors, not shown in FIG. 9 but known in the prior art, in alternative embodiments. The manipulator has an extension arm 92. The circuit substrate 96 consists of some sort of conductive material such as gold or copper from which circuit substrates can be manufactured. One should note that any material that can undergo electric discharge machining may be used, not just materials for circuit substrates.

By controlling the electrical differential between the two conductive surfaces, an arc can form between the tip of the extension arm 92 and the circuit substrate 96. The manipulator may remain in contact with the material 98 to provide power to the manipulator that causes the differential. Other means of providing power to the manipulator are possible and considered within the scope of the embodiments here. Moving the manipulator results in removal of selective portions of the conductive substrate 96. By selectively removing the circuit substrate, conductive traces can be left behind that form electrical circuits. Other embodiments use arc cutting manipulator 90 in conjunction with other processes. For example, liquid deposition process such as previously described can be used to deposit oil or other liquid reducing agents commonly used in conventional EDM.

Arc cutting falls into a category of subtractive manufacturing, where articles result from removal of material. Manipulators can also perform additive manufacturing similar to the pick and place of liquids to form conductive traces, etc. They can also build structures out of building materials or articles. FIGS. 10-15 show embodiments of a process of building a lap or lapped joint from carbon fiber rods. Although lap joints are described in detail, joints of any nature may be fabricated. One should note that the use of carbon fiber rods provides just one example, the building articles could be rods, fibers, plates, fillets, beams, etc. Other sorts of building materials could easily substitute into this or similar processes, as can other types of materials such as electronics components, etc. High aspect ratio materials or articles such as rods and platelets are particularly advantageous as building materials since they allow building to reach near full tensile strength of the base material using simple lap joints. For a given size lap joint, higher aspect ratio materials make the joint size relatively small compared to the unbonded region. Parameters such as strength-to-weight ratio generally approach that of the base material as the aspect ratio is increased if the length of the lap joint is fixed.

Figure 10:
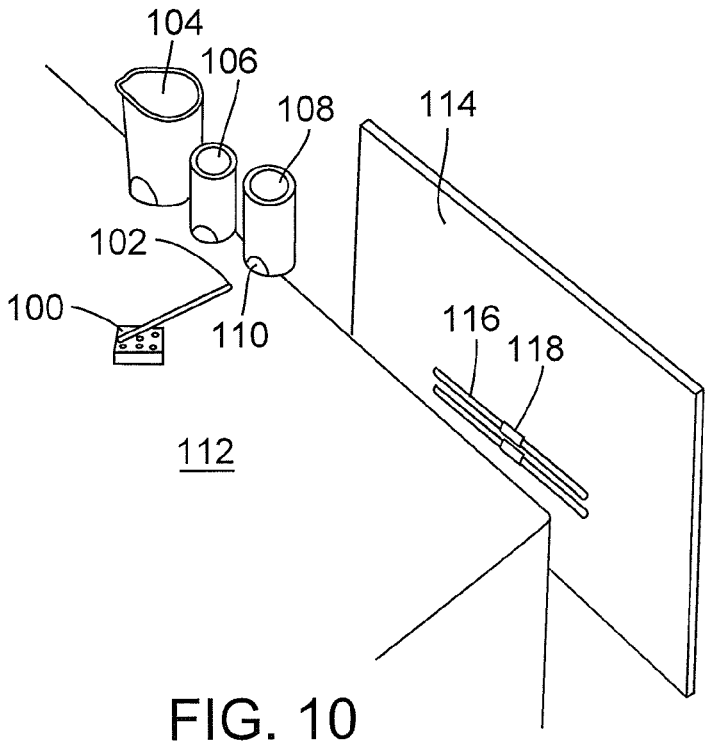
FIGS. 10-16 show embodiments of levitated manipulators building lap joints.

In FIG. 10, the factory 'floor' or surface has a manipulator 100 on a diamagnetic surface 112. This particular manipulator has a dip tip 102. The manufacturing floor also has a water reservoir 104, a UV adhesive reservoir 106, and an epoxy reservoir 108. The reservoirs are accessed by the dip tip through access ports such as 110. Next to the movement surface 112 is a building surface 114. As can be seen, several lap joints have already been constructed such as joint 118 out of carbon fiber rods such as 116. In this instance, the manipulator 100 would move to epoxy reservoir 108 to load epoxy adhesive onto its tip 102.

Figure 11:
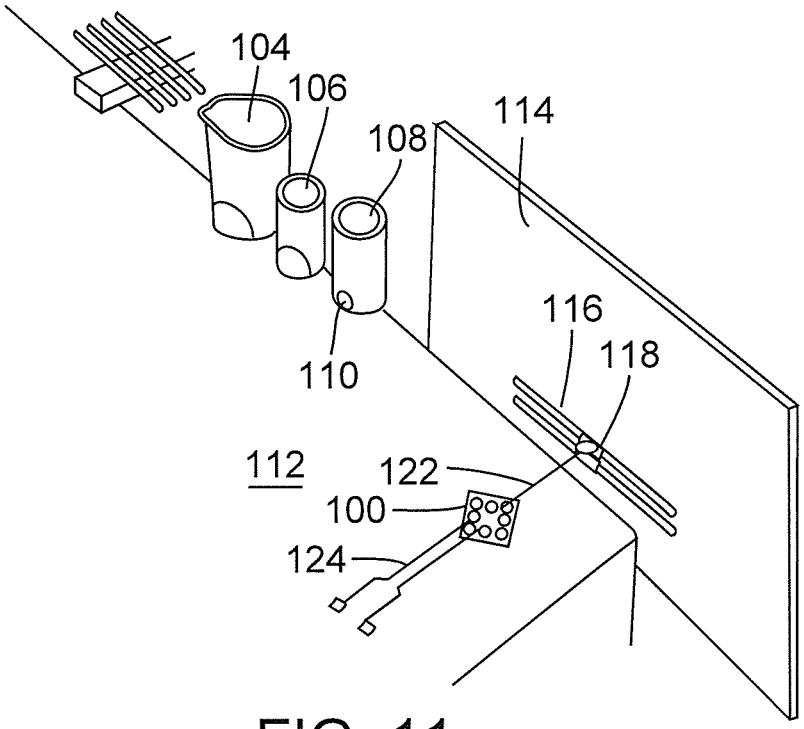

In FIG. 11, the manipulator moves to the building surface and applies the epoxy to the substrate 114 in a location adjacent the already present carbon fiber rods such as 116. The epoxy is transferred from the dip tip to the building surface by contact. This process may repeat as many times as necessary to transfer a particular amount of epoxy to the building surface.

Figure 12:
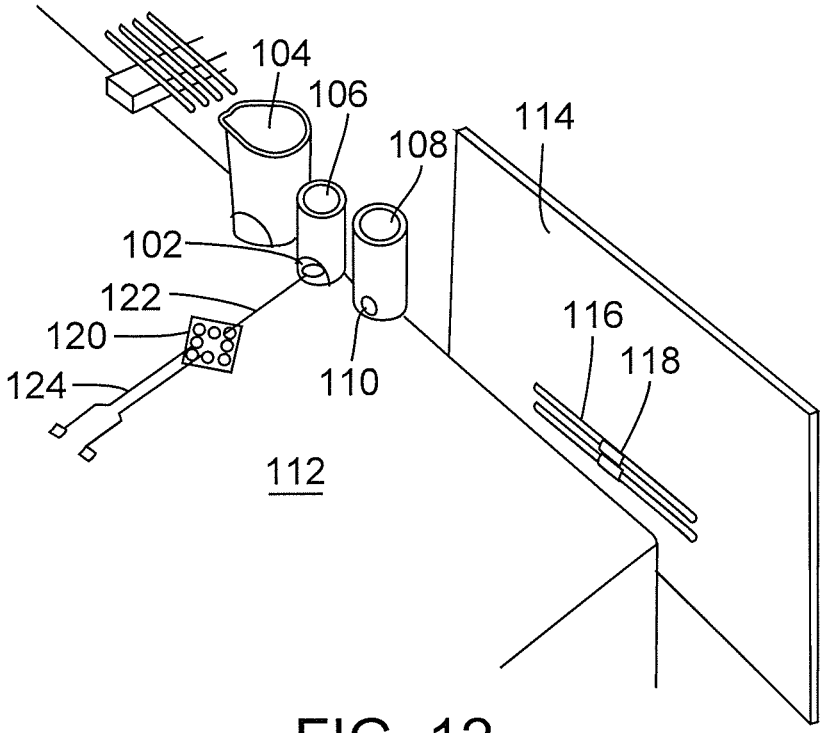

In FIG. 12, a second manipulator 120 begins work. The manipulator 120 has two end effectors, a dip tip or other liquid transfer device 122 and a forked pick up end effector 124. The liquid transfer end loads up on UV curable adhesive from the reservoir 106. The UV adhesive may cure faster than the epoxy, tacking the carbon fiber rods into place while the epoxy hardens. This provides the ability to hold the rods in place quickly, but also to have the stronger bond of epoxy.

Figure 13:
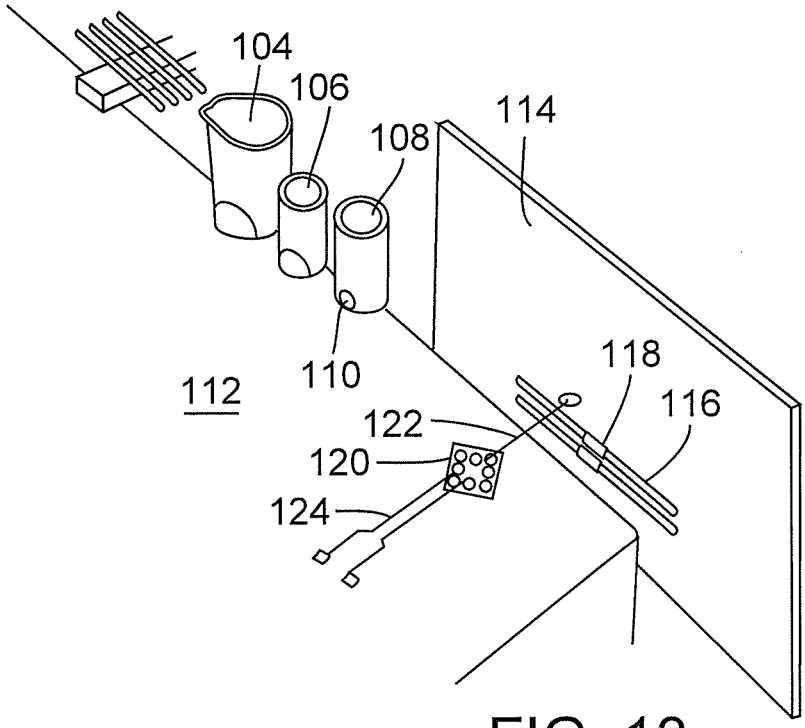
Figure 14:
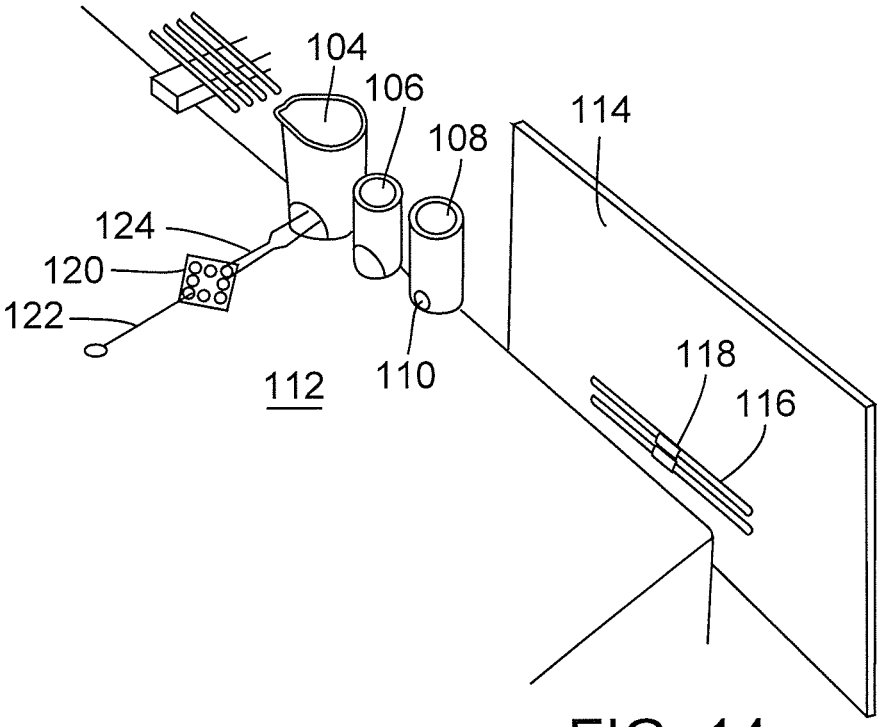

In FIG. 13, the dip tip transfers UV adhesive to the building surface 114 by contact. This process repeats as necessary to dispense the desired amount of UV adhesive to the building surface. In FIG. 14, the manipulator 120 turns around to present the pick-up end effector 124 towards the reservoirs. One should note that a second manipulator with a dip tip may not be necessary, but it may require a cleaning station to clean the epoxy off the end effector. The tip 124 is inserted into the water or other liquid reservoir 104.

Figure 15:
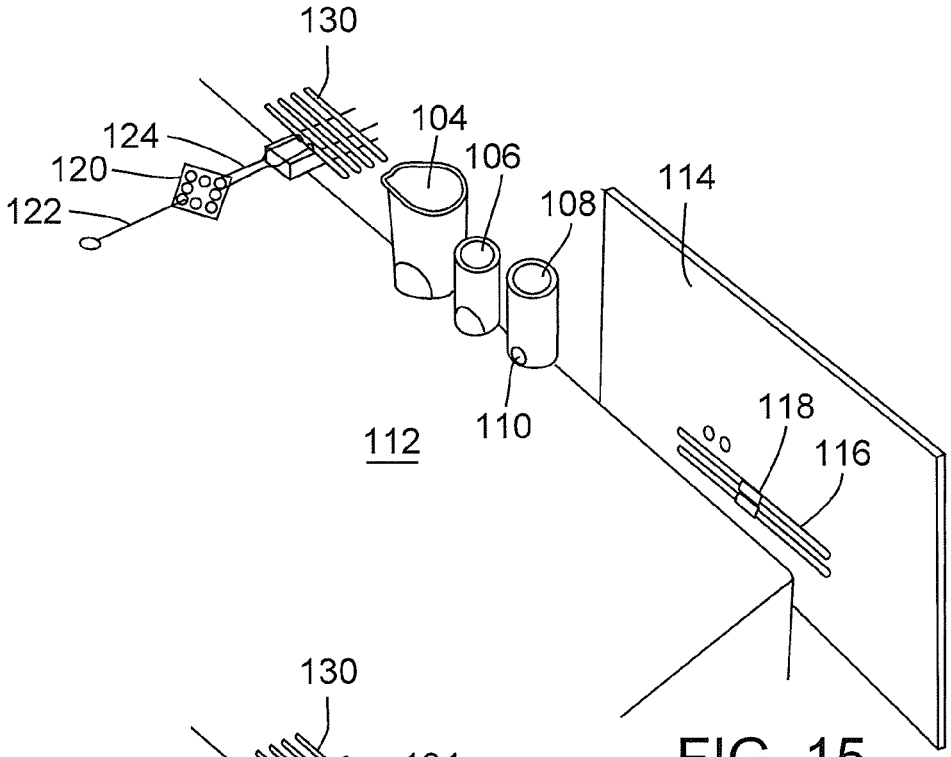
Figure 16:
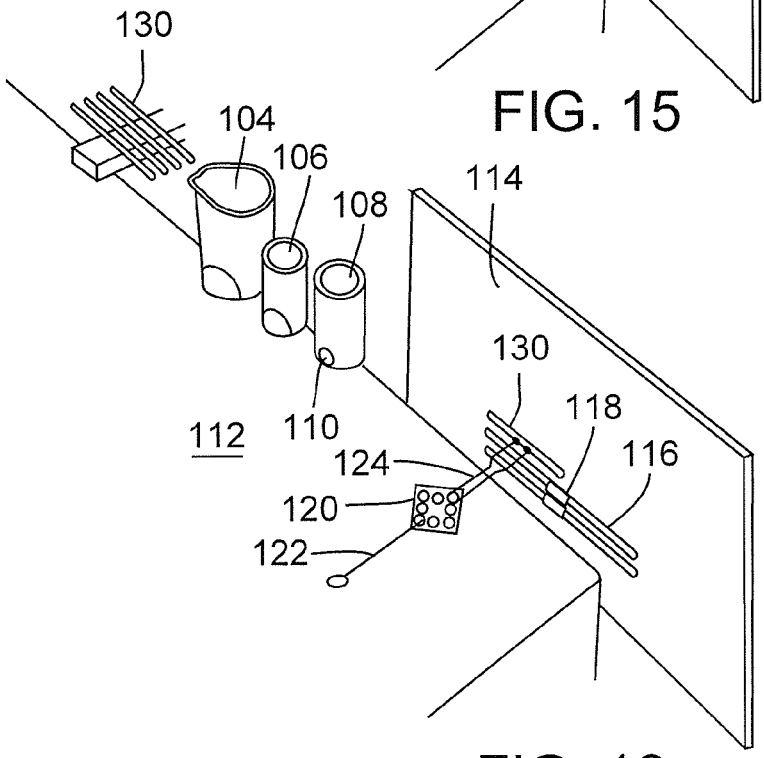

In FIG. 15, the end effector 124 picks up a carbon fiber rod from the stack after dipping into the water reservoir and picking a small amount of water on the surface of the end effector 124. Surface tension from the water or other liquid on the end effector 124 "grabs" and holds the carbon fiber rod on the forked end effector 124. Small flat or shaped pads of hydrophilic (wetting) material can be used on the ends of the forked end effector 124 to better grab the carbon fiber rod in a controlled fashion. In FIG. 16, the forked end effector puts the carbon fiber rod 130 in place against the UV adhesive and the epoxy. The rod would be held in place while the UV adhesive is cured by application of UV light. FIG. 16 shows the rod being held in place, but not the UV curing. The end effector is able to release the rod when manipulator 120 moves away from the "place" location either because the UV adhesive has greater surface adhesion than the small amount of water on the forked end effector 124, or because the UV adhesive is cured with a UV light source (not shown) and the solidified UV adhesive holds the rod firmly in place as the manipulator 120 moves away.

Figure 17:
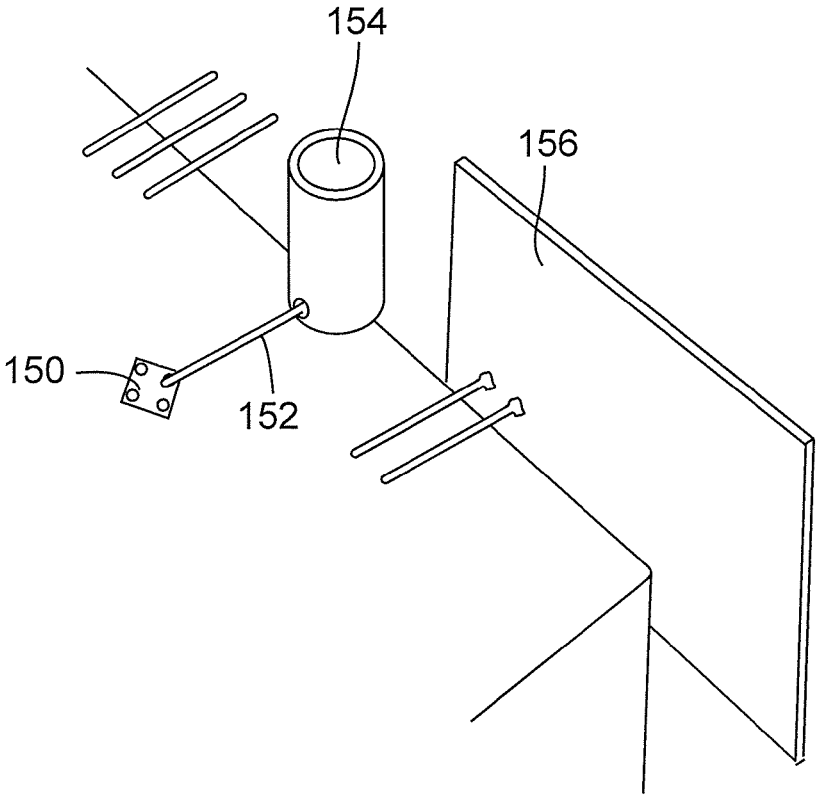
FIGS. 17-23 show embodiments of levitated manipulators building rod perpendicular to a surface.
Figure 18:
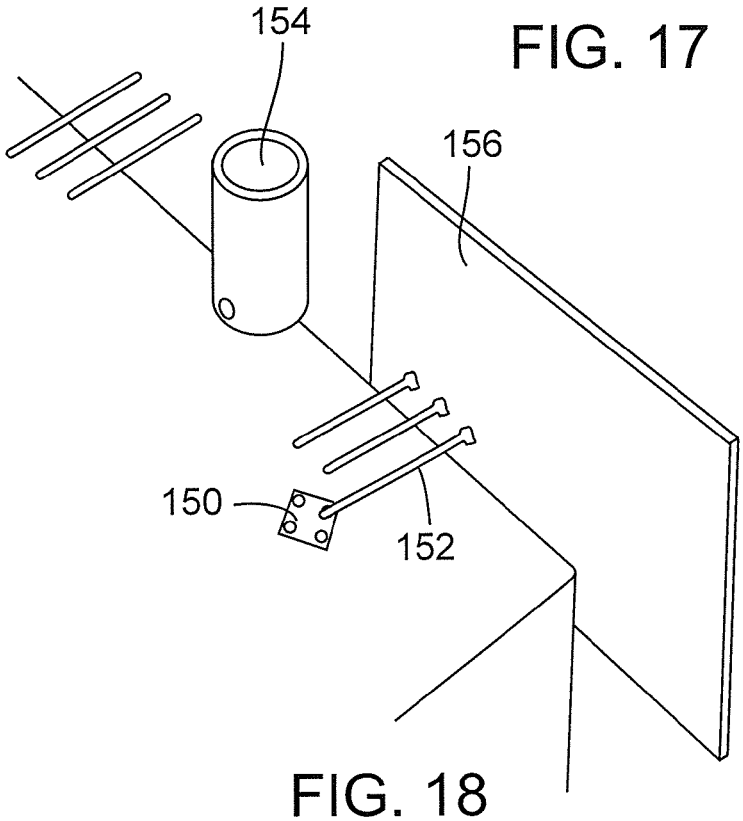

A similar process can use rods oriented perpendicular to the building surface to make longer extensions from a building surface. FIG. 17 shows a building surface 156 having carbon fiber extensions. A manipulator 150 has a dip tip or other liquid transfer device 152 that can pick up adhesive, such as epoxy or UV adhesive, from the reservoir 154. FIG. 18 shows the dip tip depositing the adhesive on the building surface 156. This process can repeat as many times as necessary to transfer the desired amount of adhesive to the building surface.

Figure 19:
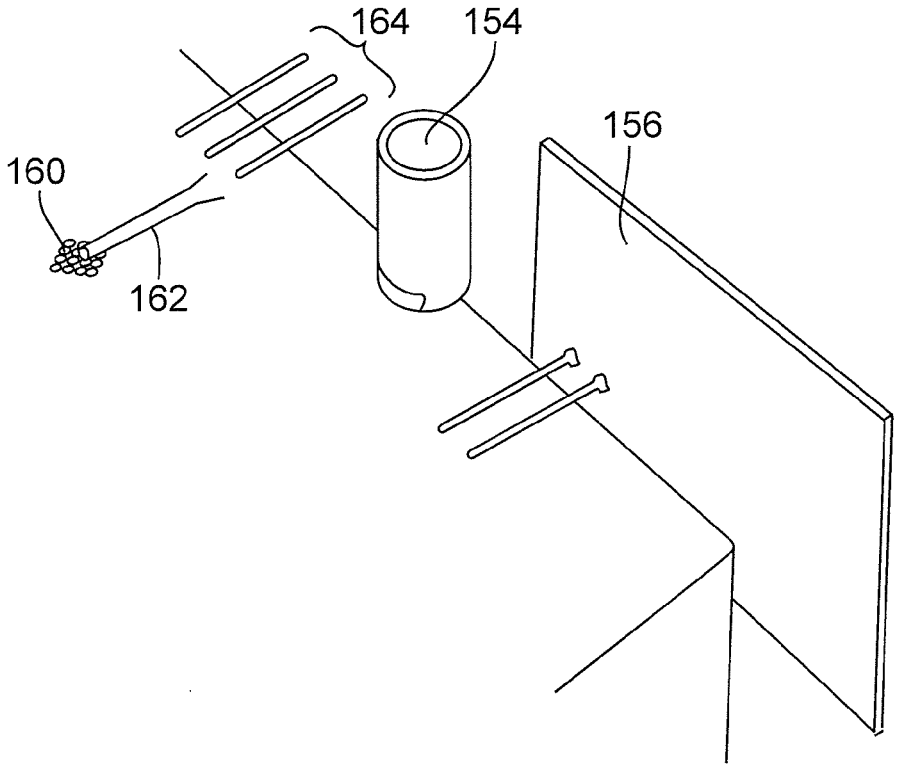
Figure 20:
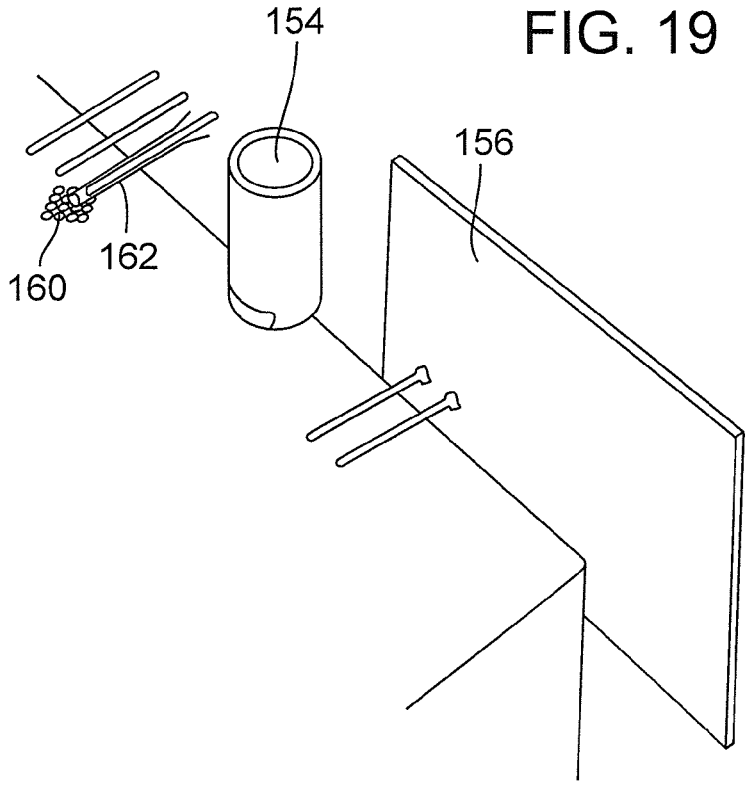
Figure 21:
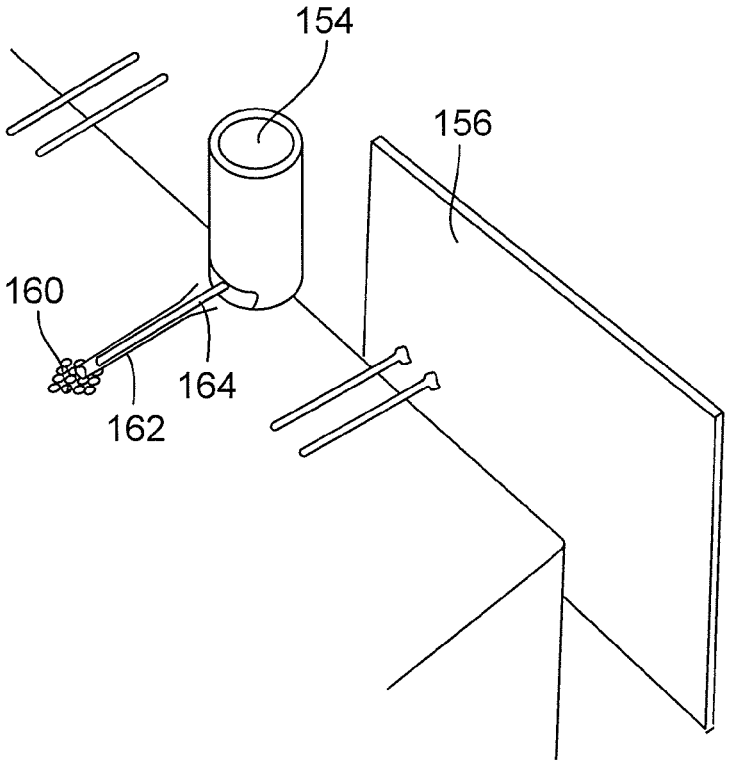

In FIG. 19, another manipulator 160 having a tubular pick up end effector 162 positions itself to pick up a carbon fiber rod 164. The pick-up end effector 162 may consist of a tube, such as a glass tube with a flared end that scoops up carbon fiber rod 164 and is able to carry it to the desired place location. In some embodiments, pick-up end effector 162 may be slightly tilted upward to prevent the tube from falling out during motion. One should note that the same manipulator could be used for both operations with the end effectors being attached at different sides. In FIG. 20, the end effector picks up the rod 164 end-on with a scooping motion. The rods may be initially resting on a slightly elevated and sloped feed platform, not show, to hold the rod tips at the level of the pick-up end effector 162. In another embodiment, the feed platform has a backstop to prevent the rods from moving backwards during the scooping motion. FIG. 21 shows the end of the rod 164 being loaded with adhesive from the reservoir 154. In the embodiment shown in FIGS. 19-23, the reservoir opening is a slot and manipulator 160 moves in a sideways motion to hold the rod against the side of the tube to prevent the rod from falling out during withdrawal of the rod from the reservoir.

Figure 22:
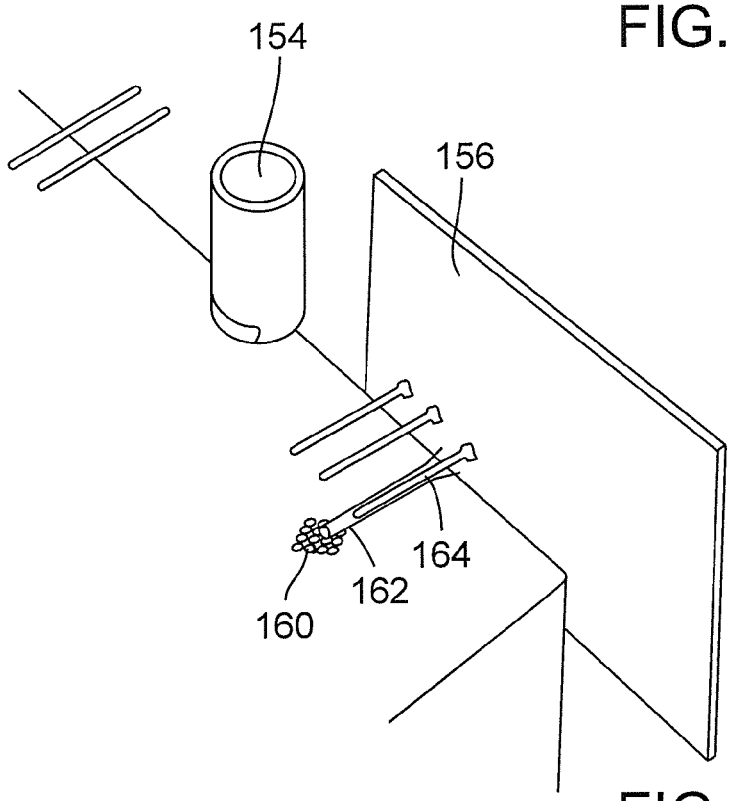
Figure 23:
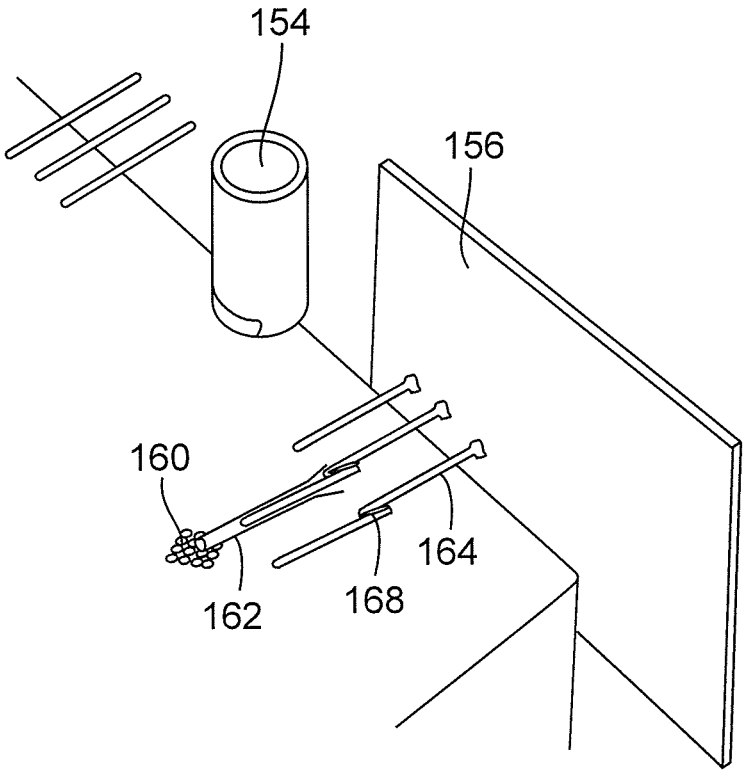

FIG. 22 shows the rod in place against the building surface at location 166 where the previous manipulator deposited adhesive. The adhesive may be a quicker drying UV adhesive or a longer setting but generally stronger bond epoxy. FIG. 23 shows an embodiment in which the extension is made longer by addition of another rod to one mounted against the substrate. The rods or other building articles can be picked up and place parallel to the building surface as in FIGS. 15-18, perpendicular to the building surface as in FIGS. 19-22, or any orientation in between, including at an angle to the building surface.

Figure 24:
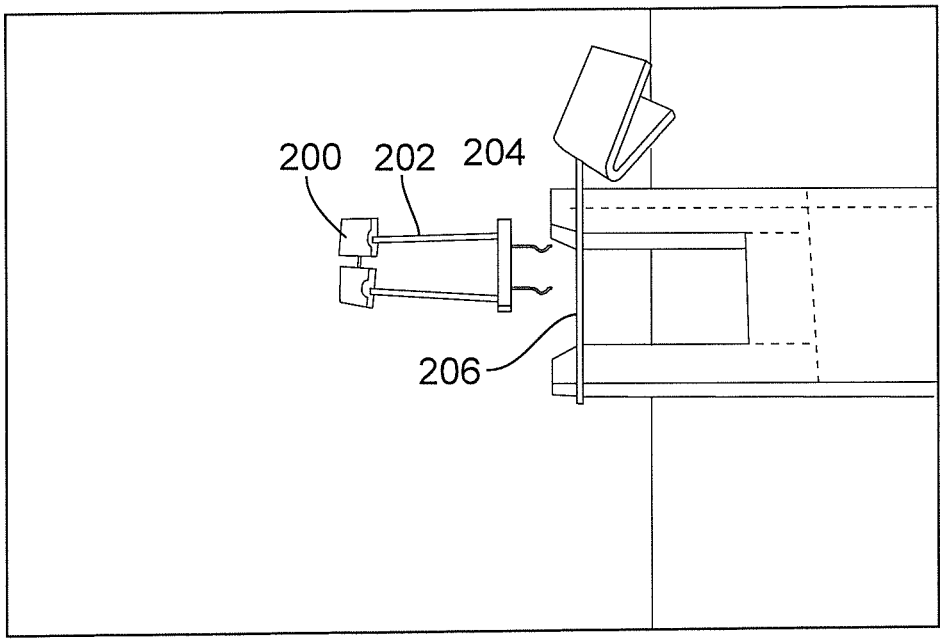
FIGS. 24-26 show an embodiment of a levitated manipulator used to pick up objects.

The discussion has mentioned different types of pick up end effectors. Another embodiment of the manipulators has the ability to move with several degrees of freedom. FIG. 24 shows a manipulator that alters its pitch, where pitch defines the movement of tilt and lift. The manipulator 200 has arms such as 202 and a bar 204 as part of the end effector. The bar 204 may be weighted to cause the manipulator to tilt at lower levels of power. Higher levels of power overcome the drag of the bar, allowing the manipulator to move more easily, but lower levels of power may cause the weight of the bar to pitch the manipulator down. In FIG. 24, the weight of bar 204 causes tilt at low levels of power but in other embodiments the weight of arms 202 is sufficient to cause tilt at low levels of power.

Figure 25:
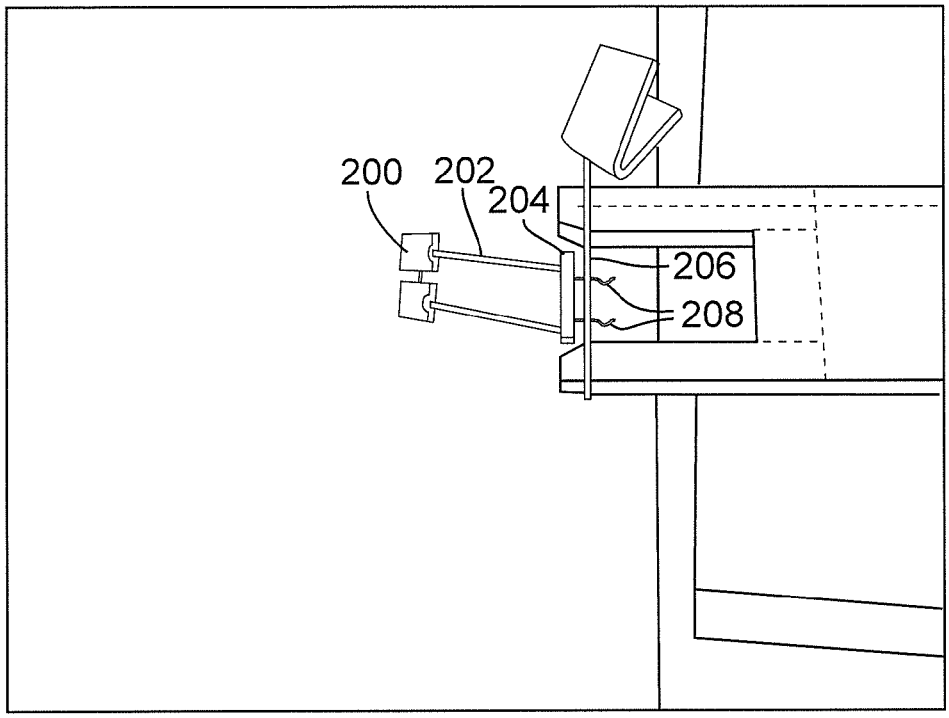
Figure 26:
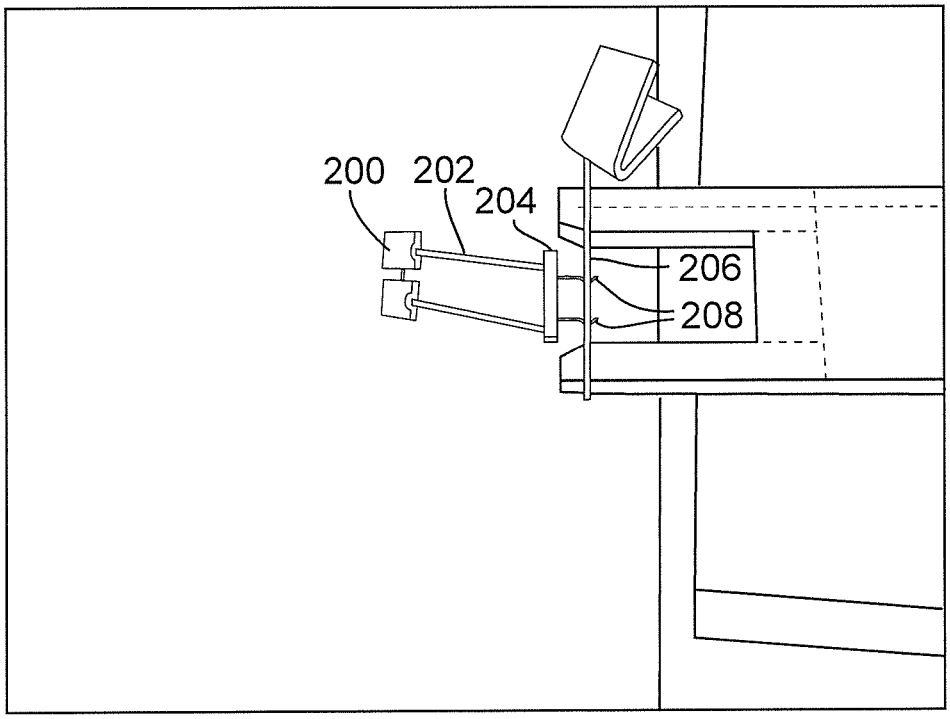

For example, in FIG. 25, a higher level of power moves the manipulator into position and then the level of power is reduced, causing the manipulator to tilt and the manipulator is moved forward at low levels of power. This positions the hooks such as 208 to go under the rod 206. In FIG. 26, a higher level of power is applied causing the manipulator to level off and pick up the rod 206 in the hooks 208. This demonstrates that the manipulators have can move with several degrees of freedom.

Figure 27:
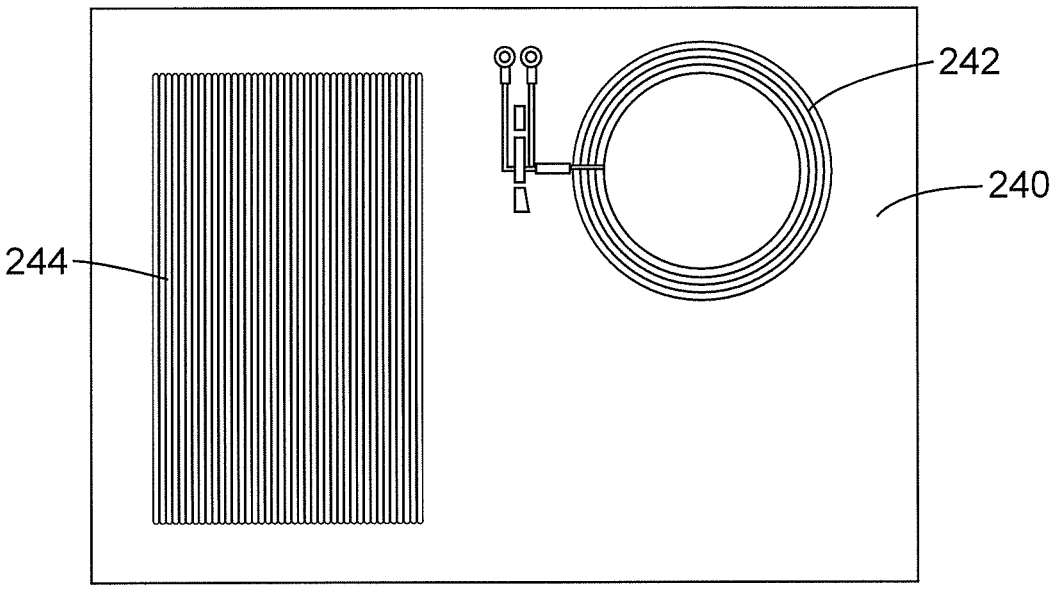
FIGS. 27-30 show an embodiment of ballistic motion.

The control of the manipulators through the conductive traces also allows for other types of movement. FIG. 27 shows a circuit substrate that has two control zones. The substrate 240 would typically consist of a circuit substrate manufactured by well-known and established manufacturing processes. In this embodiment the control zones consist of a circular set of traces 242, a first control zone, and a rectangular grid of traces 244, a second control zone. In some instances it may be necessary for the manipulators to transition from one control zone to another without any intervening traces for control. The manipulator accomplishes this through ballistic motion.

Figure 28:
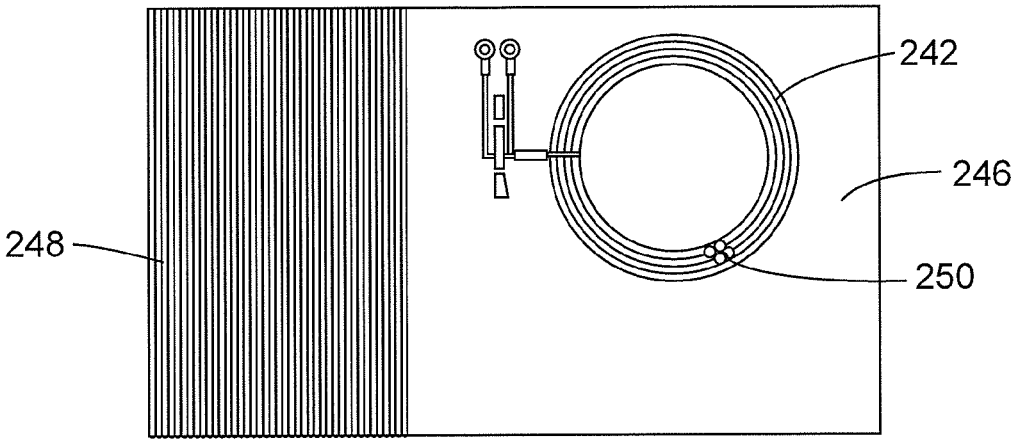
Figure 29:
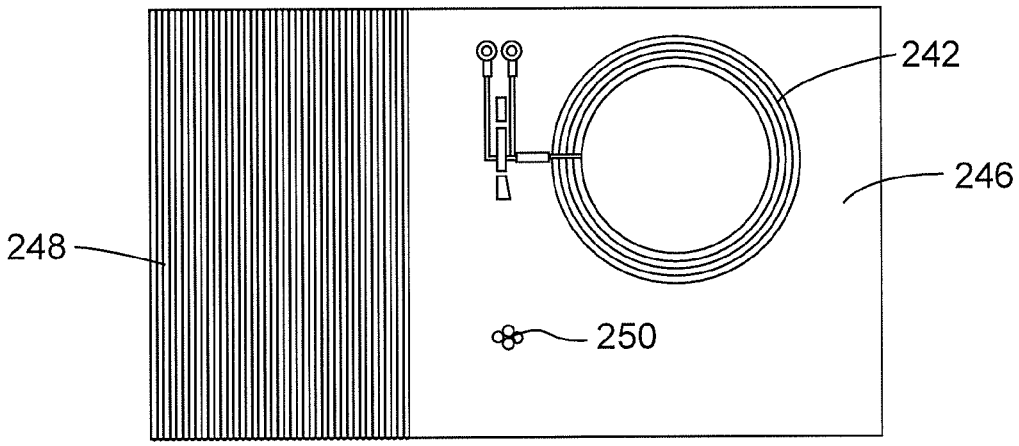
Figure 30:
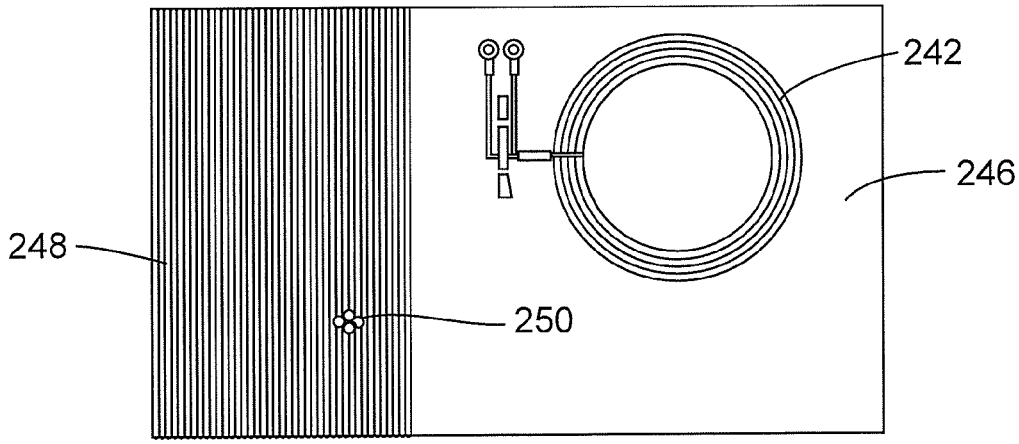

In FIG. 28, the manipulator 250 is shown on a first surface, under which lies the circuit substrate 240. The first surface corresponds to the first control zone 246. The desired system goal is for the manipulator to go to the second control zone 248, which lies over the rectangular portion of the circuit substrate of FIG. 27. The traces underlying the first control zone are activated to cause the manipulator 250 to move at fairly high speed. At the correct time, the traces in the first control zone are turned off, causing the manipulator to exit the first control zone as shown in FIG. 29. In FIG. 30, the manipulator 250 had enough speed to cross into the second control zone 248. The control zone 248 would then take over maneuvering of the manipulator. In this manner, the manipulator crossed between control zones and in this example a material boundary between graphite on the right and copper-coated graphite on the left.

Figure 31:
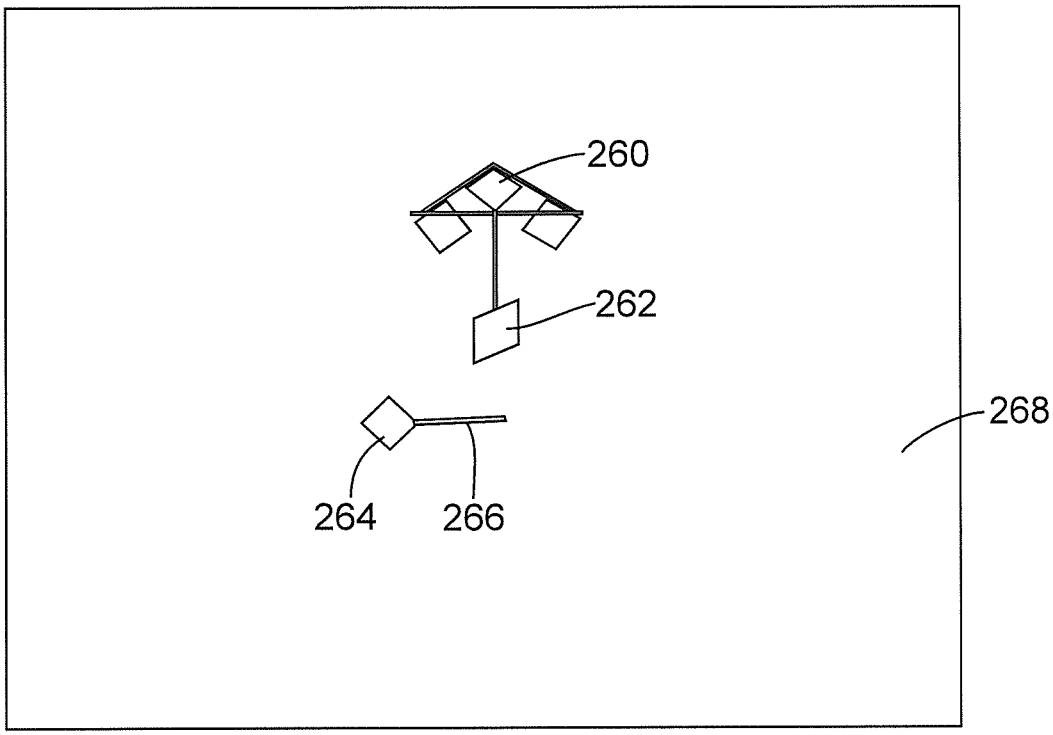
FIGS. 31-33 show an embodiment of cooperative manipulators.
Figure 32:
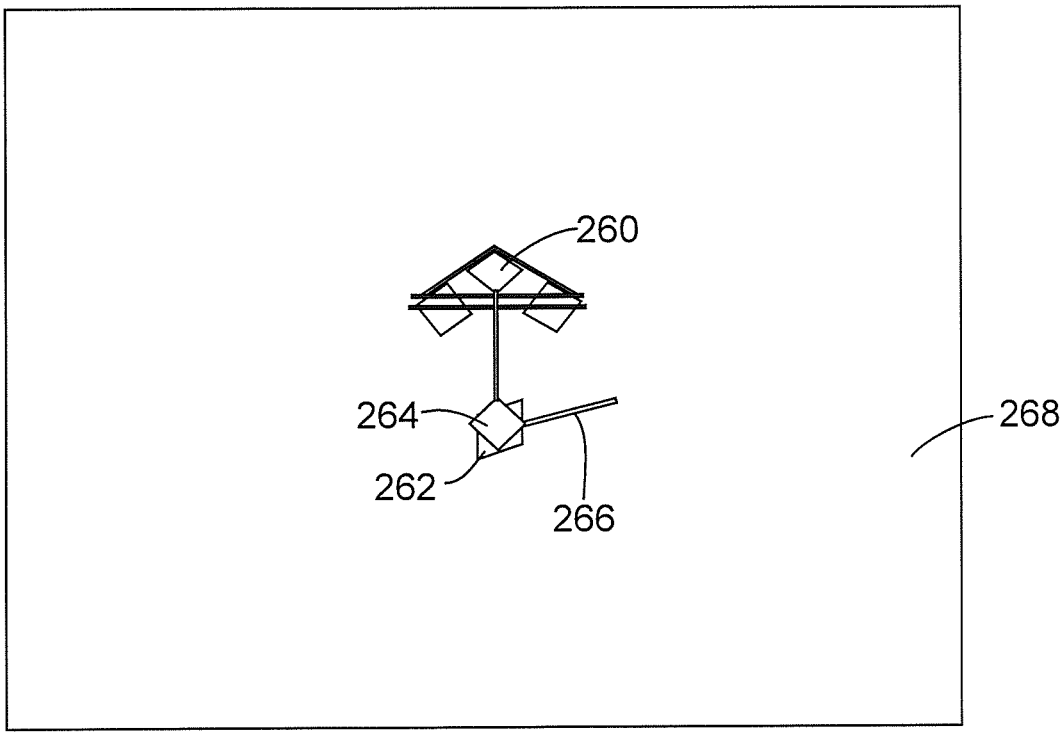
Figure 33:
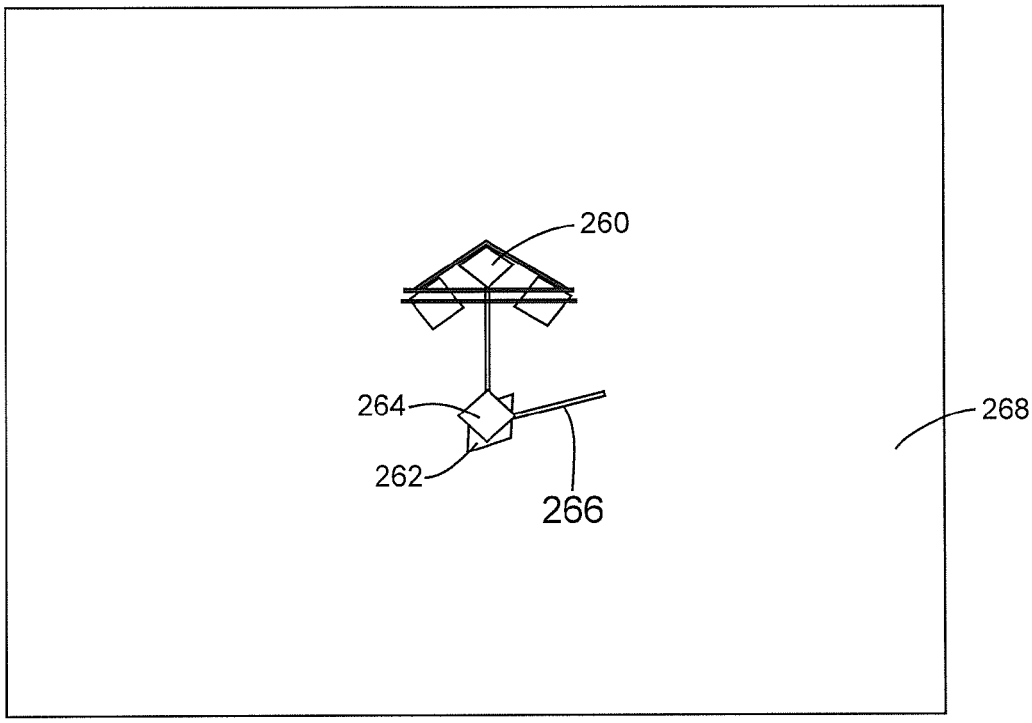

The flexibility and scale of these types of manipulators have very few limits. FIGS. 31-33 show another example of cooperative manipulators. Similar to the examples of carbon rod building using two manipulators, it is possible for the manipulators to actually cooperate more than just performing different tasks or using different materials. In FIG. 31, the circuit substrate has a first manipulator 260 having a ramp 262. A second manipulator 264 has a dip tip end effector 266. One should note that these are merely examples, and no limitation is intended by this, nor should any be inferred.

The first manipulator 260 positions the ramp 262 such that the other manipulator 264 can use it. FIG. 32 shows the second manipulator 264 on the ramp 262. This allows the end effector of the second manipulator to be raised higher in the air than would otherwise be possible. The first manipulator would then move and transport the second manipulator, as shown in FIG. 33. Depending on the specific embodiment, the second manipulator may be driven by the printed circuit board traces to move with the first manipulator to reduce the first manipulator's load, or may be transported as an undriven load.

Figure 34:
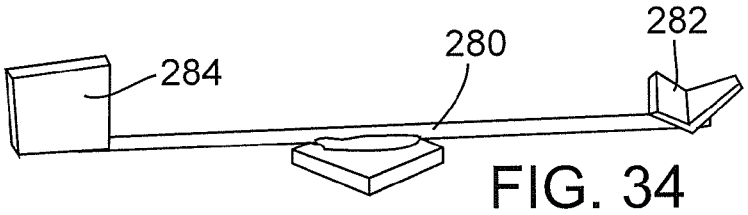
FIG. 34 shows an embodiment of a weighing manipulator.

The manipulators may also accomplish other tasks. Because of the repeatable, precise motions possible with levitated manipulators, they may provide measuring and sensing capabilities. For example, FIG. 34 shows a levitated manipulator 280 having a weighing pan 282. A counterbalance 284 resides at the other end to provide the counterbalance and to interrupt a measuring optical beam. When a mass rests in the weighing pan, the levitated manipulator 280 tilts slightly compared to an unloaded manipulator, and the trajectory of the manipulator through a small distance can be measured and the comparison to an unloaded manipulator trajectory allows one to determine a mass. Estimates place the ability of the manipulator to weigh masses as small as 10 micrograms. An added benefit lies in the fact that the manipulator does not have to stop to make a precision measurement.

Figure 35:
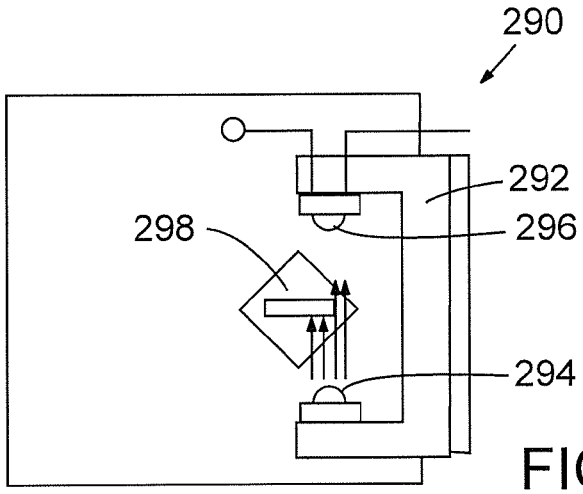
FIG. 35 shows an embodiment of an optical measuring system for measuring trajectories of levitated manipulators.

Measuring the trajectories may be accomplished in many ways. FIG. 35 shows a top view of a measuring system 290 in which an IR emitter 294 projects a beam of light towards a photodetector 296. When the manipulator 298, or the fin on the counterbalance on the manipulator 284, partially breaks the beam of light, the position and trajectory of the manipulator is determined by the photosensor 292. In one embodiment, the top of the counterbalance 284 passes approximately through the midpoint or mid-level region of the optical beam to determine the height of the top of the counterbalance 284 as it passes through the beam. Since the height of the top of the counterbalance 284 depends on the tilt of manipulator 298, which in turn depends on the weight in the weighing pan 282, the weight is thus measured. This consists of one possible measuring system, many others are possible.

In this manner, diamagnetically levitated manipulators may perform many different material handling tasks with many different modes of movement. While the diamagnetically levitate manipulators here are all micro-manipulators in that they are all on the micron or millimeter scale, no limitation to any particular size is intended, nor should any be inferred. These devices scale both in number and in size.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A method of building structures using diamagnetically levitated manipulators, comprising:

depositing, with a first end effector attached to a first manipulator, a first adhesive at a first location on a first surface;

picking up, with a second end effector, an article;

moving the article to the surface with the second end effector; and placing the article on the adhesive on the surface with the second end effector.

2. The method of claim 1, wherein the article comprises one of an electronic component and building material.

3. The method of claim 2, wherein picking up an article comprises picking up a building article such as a rod, fiber, beam, plate, or a fillet.

4. The method of claim 1, wherein the first and second end effectors reside on a same manipulator.

5. The method of claim 1, wherein the second end effector is positioned to pick up the building article such that the building article can be inserted into a reservoir of adhesive prior to moving the building article to the surface and placing it on the surface.

6. The method of claim 5, further comprising curing the adhesive while the manipulator holds the building article in place.

7. The method of claim 1, wherein picking up the building article comprises wetting an end of the end effector with a liquid and using surface tension of the liquid to pick up the building article.

8. The method of claim 1, wherein depositing the adhesive on a surface comprises depositing the adhesive on the building surface.

9. The method of claim 1, wherein depositing the adhesive on a surface comprises depositing the adhesive on another building article on the surface.

10. The method of claim 1, further comprising:

depositing, with a third end effector, a second adhesive on the substrate, the third end effector and the second end effector being attached to a second manipulator, wherein the third end effector is attached to a different side of the second manipulator than the second end effector.

11. The method of claim 10, further comprising curing the second adhesive after the building article has been placed on the adhesive, the second adhesive being curable faster than the first adhesive.

12. The method of claim 1, wherein the depositing, picking up, moving and placing are repeated with another building article at a location adjacent the carbon fiber rod to form a joint.

* * * * *